US009617903B2

(12) United States Patent
Maier et al.

(10) Patent No.: US 9,617,903 B2
(45) Date of Patent: Apr. 11, 2017

(54) MECHANICAL JOINT INSERT

(71) Applicant: ElringKlinger AG, Dettingen (DE)

(72) Inventors: Stephan Maier, Northville, MI (US); Kristen Strasser, Gibraltar, MI (US)

(73) Assignee: ElringKlinger AG, Dettingen (DE)

( * ) Notice: Subject to any disclaimer, the term of this patent is extended or adjusted under 35 U.S.C. 154(b) by 18 days.

(21) Appl. No.: 14/121,048

(22) Filed: Jul. 24, 2014

(65) Prior Publication Data

US 2016/0024990 A1 Jan. 28, 2016

(51) Int. Cl.
*F01N 13/18* (2010.01)

(52) U.S. Cl.
CPC ..... *F01N 13/1811* (2013.01); *F01N 2450/00* (2013.01)

(58) Field of Classification Search
CPC ..... F01N 13/1811; F01N 13/1827; F16J 15/0825; F16J 15/0831; F16B 5/0621; F16B 5/0628; F16B 5/0635; F16B 5/0642
See application file for complete search history.

(56) References Cited

U.S. PATENT DOCUMENTS

| | | | | |
|---|---|---|---|---|
| 7,059,610 | B2 | 6/2006 | Hegmann | 277/598 |
| 2003/0044632 | A1* | 3/2003 | Schonleber et al. | 428/595 |
| 2012/0139189 | A1* | 6/2012 | Schweiger | 277/594 |

FOREIGN PATENT DOCUMENTS

CA 2553583 A1 * 2/2007 ..... C09D 127/12

* cited by examiner

*Primary Examiner* — Audrey K Bradley

(57) ABSTRACT

A multi-layer joint insert is provided at one or more joints between an engine exhaust manifold and a component mounted by fasteners on the exhaust manifold, as well as between the component and the fastener heads/nuts, to reduce wear and failure at the one or more joints. The joint insert includes a first sheet metal layer having at least one fastener-receiving opening and a second sheet metal layer having at least one fastener-receiving opening, wherein the first and second sheet meal layers are joined by at least one connecting arrangement that permits relative sliding movement between the first and second sheet metal layers in response to thermally-induced movement at the one or more joints, thereby reducing wear and failure at the one or more joints.

2 Claims, 9 Drawing Sheets

MECHANICAL JOINT INSERT

FIELD OF THE INVENTION

The present invention relates to a multi-layer joint insert for use at a mechanical joint between components where relative movement of the components occurs and can lead to wear and/or failure of the components.

BACKGROUND OF THE INVENTION

An exhaust manifold of an internal combustion engine may have mounted thereon other components of the engine such as an EGR valve assembly, a turbocharger and other components, that can distort the sealing face of the exhaust manifold. As a result, it may be necessary to further support the exhaust manifold by some type of support bracket that be connected by bolts or other fasteners to the exhaust manifold and to a relatively rigid part of the engine such as to the cylinder head or engine block.

However, during operation of the internal combustion engine, significant amounts of thermal growth can occur between the hot exhaust manifold and the support bracket. Such differential thermal growth generates stresses at the mechanical joints where the exhaust manifold and support bracket are fastened and can cause wear and failure of the exhaust manifold, fastener, and/or support bracket.

SUMMARY OF THE INVENTION

The present invention provides a multi-layer joint insert for use at such a mechanical joints (e.g. bolted joints) between components where relative movement of the components occurs in a manner that leads to wear and/or failure of the components. The joint insert is especially useful for, although not limited to, use at a mechanical joint where relative movement of the components occurs as a result of thermal growth differences between the components.

In an illustrative embodiment of the present invention, the joint insert is placed at such a mechanical joint wherein the joint insert comprises a first metal sheet layer having at least one fastener-receiving opening and a second metal sheet layer having at least one fastener-receiving opening and wherein the first metal sheet layer and the second metal sheet layer are joined by at least one connecting arrangement that permits relative sliding movement between the first metal sheet layer and the second metal sheet layer in response to relative movement of the components at the joint, such as is experienced between the aforementioned exhaust manifold and support bracket as a result of thermally-induced stresses during operation of the internal combustion engine.

In another illustrative embodiment of the present invention, the second metal sheet layer of the joint insert can comprise separate second metal sheet layers placed proximate to respective fasteners or groups of fasteners, wherein each of the separate metal sheet layers is joined to the same shared first metal sheet layer by a respective connecting arrangement to form a one-piece joint insert unit.

Multiple such joint inserts can be provided for respective multiple joints pursuant to embodiments of the present invention. Alternately, a unitary joint insert can be provided for use and ease of assembly with multiple joints between components.

A unitary joint insert pursuant to still another illustrate embodiment of the present invention for use at first and second different mechanical joints includes first and second joint insert sections of the type described above for placement at the different joints, wherein the shared first metal sheet layer is modified to include a metal sheet connector section that joins the first joint insert section and the second joint insert section together as one unit; for example as a U-shaped unit wherein the first and second joint insert sections form the legs of the U-shape.

In other embodiments of the present invention, an anti-friction material is provided at the interface between the first and second metal sheet layers. The material can comprise a molybdenum disulfide coating, chromium coating, bronze coating, or other coating on one or both of the first and second sheet metal layers when the joint insert(s) is/are used between an exhaust manifold and a component fastened to the exhaust manifold.

The present invention envisions an embodiment involving the combination of an exhaust manifold of an internal combustion engine and a component fastened to the exhaust manifold at one or more joints by at least one fastener, and a joint insert according to any of the above illustrative embodiments disposed at the one or more joints between the exhaust manifold and the component.

The present invention also envisions in still another embodiment a method of joining an exhaust manifold of an internal combustion engine and another component by placing a joint insert according to any of the above embodiments at one or more joints between the exhaust manifold and the component, as well as between the component and heads/nuts of one or more fasteners, and fastening the exhaust manifold and the component together at the one or more joints using the one or more fasteners that is/are received in respective mutually-aligned fastener-receiving openings in the first metal sheet layer and the second metal sheet layer.

Further features and advantages of the invention are the subject matter of the following description and of the drawings of embodiments.

DETAILED DESCRIPTION OF THE INVENTION

Although the present invention will be described below for purposes of illustration with respect to a joint insert for placement at joints between an exhaust manifold of an internal combustion engine and a support bracket joined together by fasteners, the present invention can be practiced with respect to other types of mechanical joints present between components where relative movement of the components can lead to wear and/or failure of the components. The relative movement can occur as a result of thermal growth differences between components or other factors, such as bolt load loss.

Figure 1:
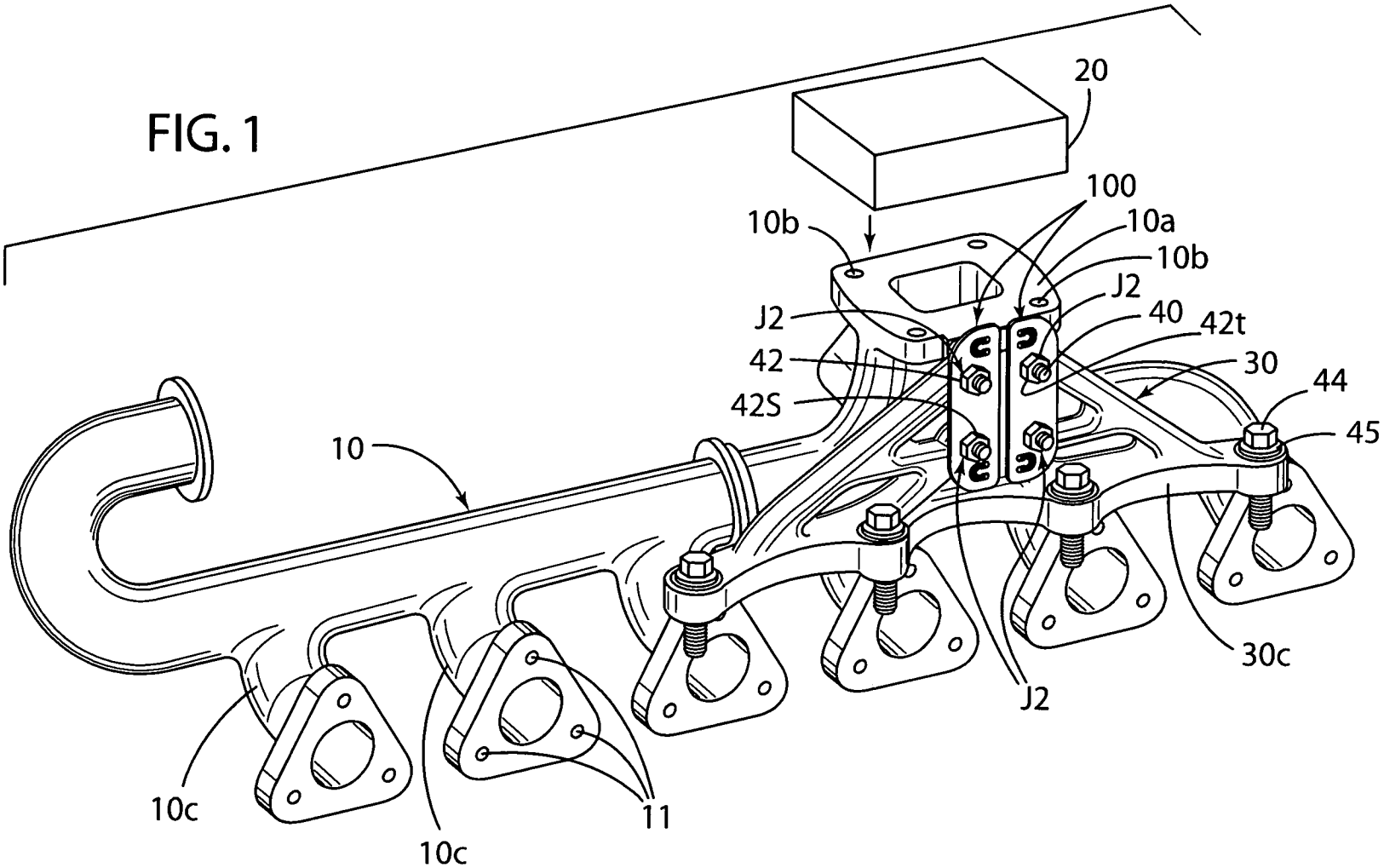
FIG. 1 a perspective view of an exhaust manifold of an internal combustion engine and a support bracket connected to the exhaust manifold by threaded stud bolts (fasteners) at mechanical (e.g. bolted) joints. A turbocharger is shown schematically for mounting on the exhaust manifold.

Referring to FIG. 1, the exhaust manifold 10 comprises a surface or face 10*a* on which a turbocharger 20 (shown schematically) is mounted by bolts (not shown) received in threaded openings 10*b*. The exhaust manifold also includes multiple exhaust port, extensions 10*c* that are communicated to the exhaust ports of the cylinder head of the internal combustion engine as is well known. The exhaust port extensions 10*c* are fastened to the cylinder head by threaded bolts (not shown) received in openings 11 with a sealing gasket (not shown) placed betwen each respective exhaust port extension 10*c* and the cylinder head as is well known and not forming part of the invention.

Figure 2:
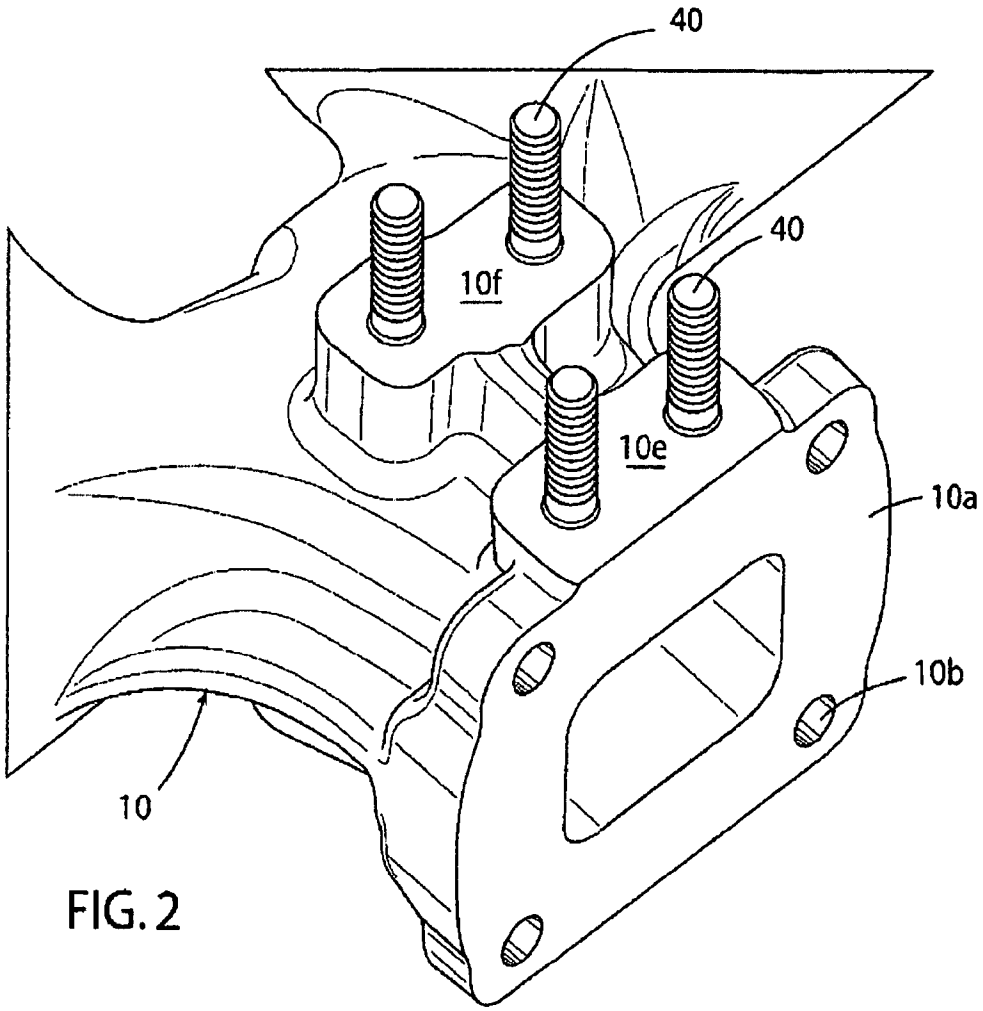
FIG. 2 an enlarged view of a face of the exhaust manifold where the support bracket is mounted by the threaded stud bolts shown.

The exhaust manifold 10 also includes first and second joint surfaces or faces 10*e*, 10*f* to which a support bracket 30 is mounted by threaded stud bolts 40/nuts 42 (fasteners), FIGS. 1-2. The joint surfaces or faces 10*e*, 10*f* are shown for purposes of illustration as being flat and generally rectangular in profile, but can have any configuration. Moreover, a single joint surface or face can be provided on the exhaust manifold 10 in lieu of the multiple joint surfaces or faces 10*e*, 10*f* shown, depending upon the design selected for the exhaust manifold and the support bracket.

A support bracket 30 is shown fastened to the exhaust manifold 10 by the threaded stud bolts 40/threaded nuts 42 (fasteners). The support bracket has a connection plate 30*a* connected by struts 30*b* to a flange 30*c* having four (4) sockets to receive a respective threaded bolt 44 each having a washer 45. The threaded bolts 44 are connected to the cylinder head (not shown) of the internal combustion engine or to another relatively rigid part thereof, such as to the engine block.

Figure 3A:
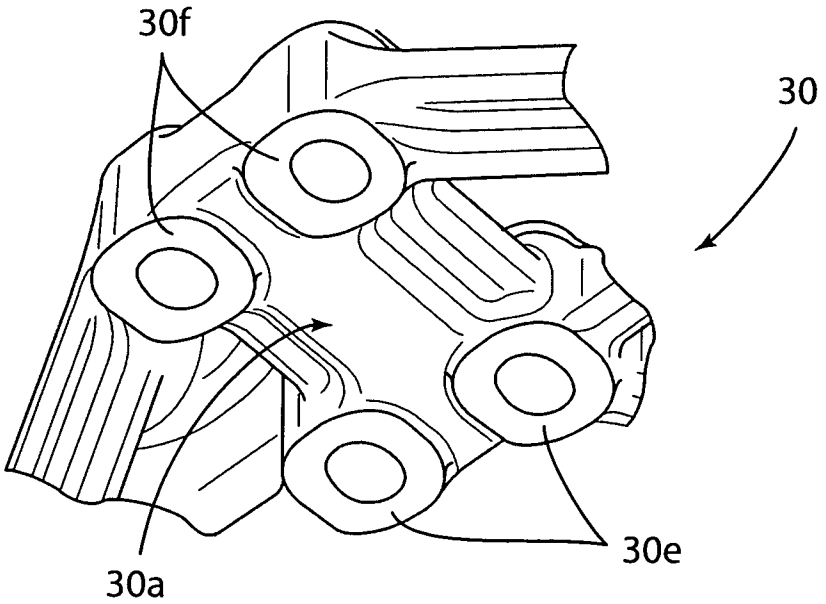
FIG. 3A an enlarged view of the inner side of the connection plate of the support bracket showing joint surfaces or faces thereon.

The support bracket 30 has an inner side with two sets (pairs) of inner joint surfaces or faces 30*e*, 30*f*, FIG. 3A, which face the corresponding first and second joint surfaces or faces-10*e*, 10*f* of the exhaust manifold 10. The joint surfaces or faces 30*e*, 30*f* are provided on the bracket connection plate 30*a* and have a flat, generally circular configuration, but they can have any desired configuration. Moreover, a single joint surface or face can be provided on the support bracket 30 in lieu of the multiple joint surfaces or faces 30*e*, 30*f*, depending upon the design selected for the exhaust manifold and the support bracket.

Figure 3B:
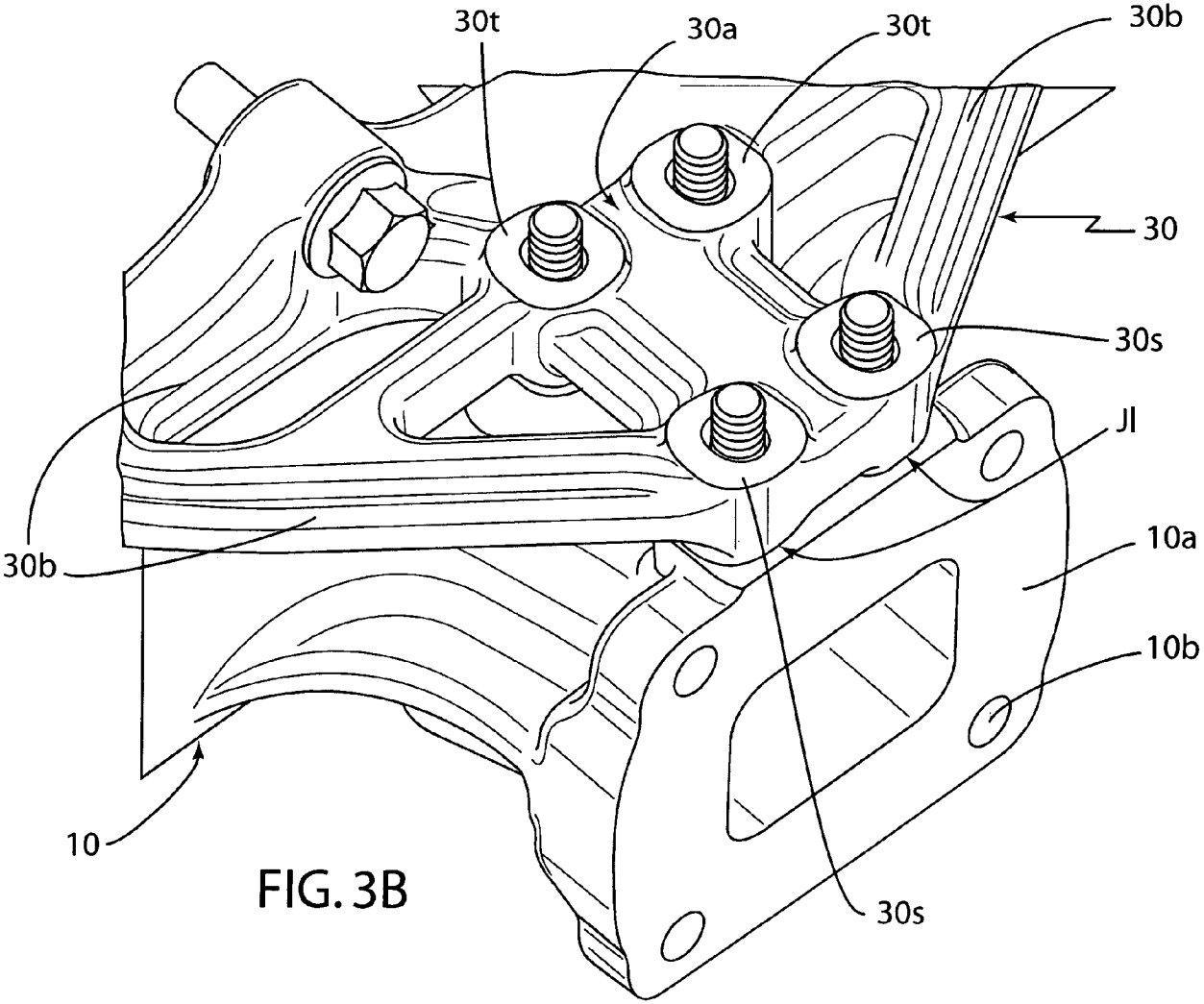
FIG. 3B an enlarged view similar to FIG. 2 showing the support bracket and a joint insert disposed on the joint surfaces or faces of the exhaust manifold with the threaded stud bolts received in mutually-aligned fastener-receiving openings in the support bracket and joint insert(s)

The support bracket 30 also includes two sets (pairs) of outer joint surfaces or faces 30*s*, 30*t*, FIG. 3B, which face away from the corresponding joint surfaces or faces 10*e*, 10*f* of the exhaust manifold 10 on an opposite outer side of the connection plate 30*a*, FIG. 3B. The outer joint surfaces or faces 30*s*, 30*t* are flat and have a generally circular configuration, but they can have any desired configuration.

Moreover, a single joint surface or face can be provided on the support bracket 30 in lieu of the multiple joint surfaces or faces 30*s*, 30*t* shown, depending upon the design selected for the exhaust manifold and the support bracket.

It is apparent that one or more first mechanical joints are formed between the joint surfaces or faces 10*e*, 10*f* of the exhaust manifold 10 and the facing inner joint surfaces or faces 30*e*, 30*f* of the support bracket 30. These first joints collectively are designated J1, FIGS. 3B and 7.

Also, one or more second different mechanical joints are formed between outer joint surfaces or faces 30*s*, 30*t* of the support bracket and the facing end surfaces or faces 42*s*, 42*t* of threaded nuts 42, FIG. 3B, that are threaded onto the stud bolts 40 to fasten the exhaust manfold and support bracket together. These second, different joints collectively are designated J2, FIGS. 1 and 7.

The present invention provides a multi-layer joint insert for use at the joints J1 and at the joints J2 wherein the joint inserts 100 are designed to accommodate relative movement between the exhaust manifold 10 and the support bracket 30 resulting from differential thermal growth or expansions of these components resulting from operation of the internal combustion engine, thereby reducing wear and/or failure of the exhaust manifold, support bracket and fasteners over time.

Figure 4:
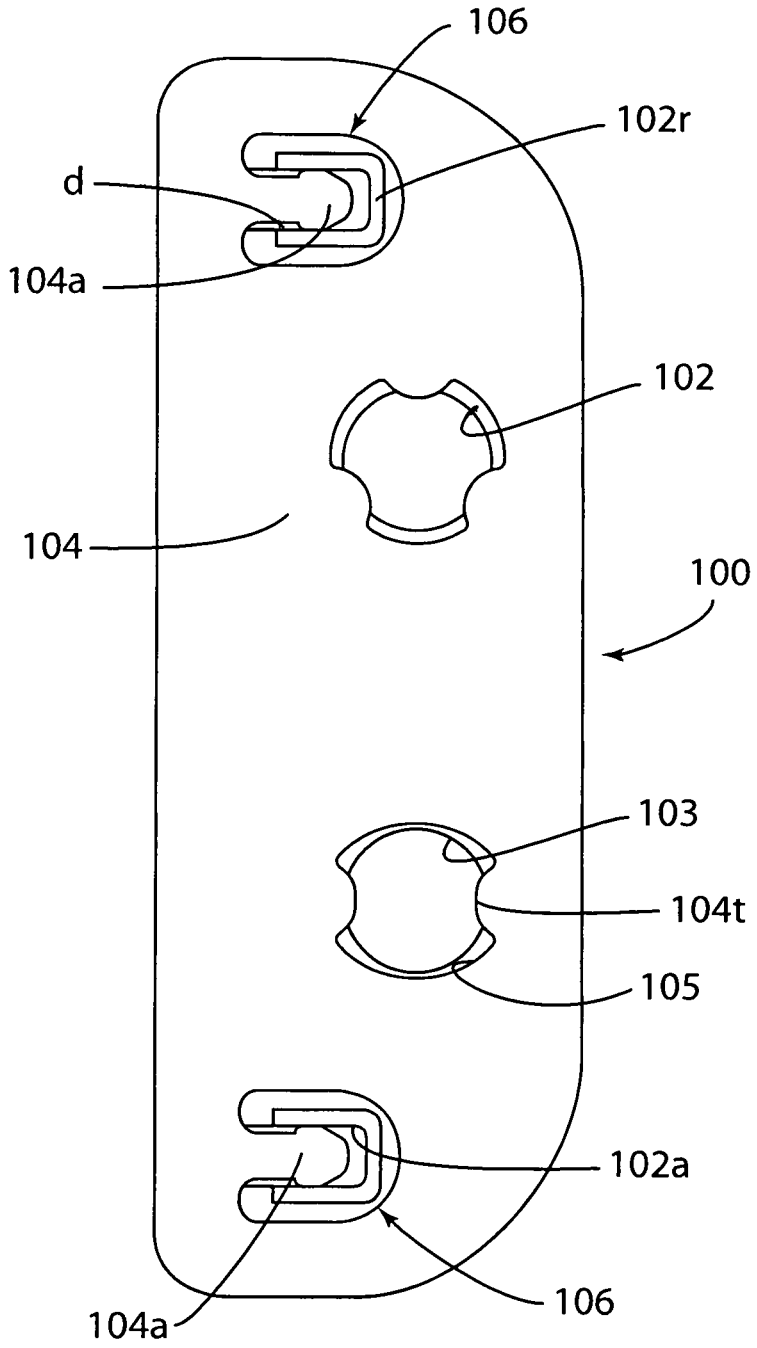
FIG. 4 a plan view of a multi-layer joint insert pursuant to one embodiment of the present invention.

A first embodiment of a joint insert is illustrated in FIG. 4 and is denoted as a whole by 100. The joint insert 100 comprises a first metal sheet layer 102 having at least one fastener-receiving opening 103 (two shown) and a second metal sheet layer 104 having at least one fastener-receiving opening 105 (two shown) each with bolt thread-engaging tabs 104t and disposed on top of the first metal sheet layer 102 in FIG. 4. The first metal sheet layer 102 and the second metal sheet layer 104 are joined by at least one connecting arrangement 106 (two shown) that permit(s) relative sliding movement between the first metal sheet layer and the second metal sheet layer in response to relative movement of the exhaust manifold 10 and support bracket 30 resulting from differential thermal growths or expansions of the hot exhaust manifold 10 and the support bracket 30 from operation of the internal combustion engine.

For purposes of illustration and not limitation, both of the first and second metal sheet layers 102, 104 are shown having a profile, in a plan view of the joint insert 100, corresponding to the generally rectangular profile of the exhaust manifold surfaces or faces 10*e*, although the first and second metal sheet layers can have any suitable profile depending upon the type of mechanical joints involved. The metal sheet layers 102, 104 are provided, in each case, with mutually aligned fastener-receiving openings 103, 105 for receiving the threaded stud bolts 40.

The connecting arrangements 106 are of the type described in U.S. Pat. No. 7,059,610, the teachings of which are incorporated herein by reference, wherein each connecting arrangement comprises an open, generally rectangular through-slot 102*a* in the first metal sheet layer 102 that receives an arrow-shaped, deformed tab 104*a* formed (e.g. stamped) in the second metal sheet layer 104 and that extends behind the first metal sheet layer and is deformed to reside in substantially the same plane as second first metal layer 102, all as described in U.S. Pat. No. 7,059,610. An embossed ridge/recess 102*r* is formed in the first metal sheet layer 102 partly around the through-slot 102*a* to receive the deformed arrow-shaped tab 104*a* so that the joint insert has substantially flat outer sides.

For purposes of illustration and not limitation, two connecting arrangements 106 are shown in FIG. 4 connecting the first metal sheet layer 102 and second metal sheet layer 104. Any number of connecting arrangements 106 can be used to this end, however.

The connecting arrangements 106 permit relative sliding movement between the first and second metal sheet layers 102, 104 in a manner to accommodate relative motion between the exhaust manifold 10 and support bracket 30 from differential thermal growth or expansions resulting from operation of the internal combustion engine. Such relative movement between the first and second metal sheet layer 102, 104 relieves or reduces thermally-induced stress at the collective joints J1 and collective joints J2 to reduce wear and/or failure of the components. The relative sliding movement occurs in the plane(s) of one or both of the first and second sheet metal layers 102, 104 in a direction corresponding to the longitudinal axis of arrow-shaped tab 104*a* and also in a sideways direction normal to the arrow-shaped tab 104*a* as determined by the clearance space "d" between the side of the tab 104*a* and the side of the through-slot 102*a*. Wear and failure of the exhaust manifold 10, support bracket 30, and stud bolts/nuts 40, 42 resulting from such relative movement of the components at the joints is thereby reduced.

For purposes of illustration and not limitation, the first and second metal sheet layers 102, 104 are manufactured from a stainless steel sheet, for example from a Type 430 ferritic stainless steel sheet, although other suitable materials can be used, such as other ferritic, austenitic or precipitation hardening stainless steel sheets, or other materials with suitable properties for use between the exhaust manifold and the support bracket.

For purposes of illustration and not limitation, the thickness of the first and second metal sheet layers 102, 104 can be the same or different and can be in the range of about 0.1 to about 0.4 mm, although other suitable metal sheet thicknesses can be used in practice of the invention.

An anti-friction material preferably is disposed between the first and second metal sheet layers 102, 104 to reduce interlayer friction. The anti-friction material can include, but are not limited to, molybdenum disulphide ($MoS_2$), chromium, bronze, or other suitable agent that is operable to reduce interlayer friction at the temperatures experienced by the joints J1, J2. The anti-friction material can be provided as a coating on one or both of the first and second metal sheet layers 102, 104 at their interface. The anti-friction material also may be provided on other surfaces of the first and second metal sheet layers 102, 104. Other coatings which can be used include, but are not limited to, chromium coating or bronze coating.

The first embodiment of the invention thus provides a combination of exhaust manifold 10 of an internal combustion engine and a component, such as support bracket 30, fastened to the exhaust manifold by stud bolts 40/nuts 42, and respective joint inserts 100 as described above disposed at the collective joints J1, J2.

Pursuant to a method embodiment of the invention, first and second joint inserts 100 are placed on the respective first and second joint surfaces or faces 10*e* of the exhaust manifold 10 with the stud bolts 40 extending through the mutually aligned fastener-receiving openings 103, 105, FIG. 3B. Then, the connection plate 30*a* of the bracket 30 is placed on the respective previously-installed first and second joint inserts 100 with the joint surfaces or faces 30*e*, 30*f* of the connection plate 30*a* facing the respective joint surfaces or faces 10*e*, 10*f* of the exhaust manifold. Additional third and fourth joint inserts 100 of the same type as described then are similarly placed on the opposite outer joint surfaces or faces 30*s*, 30*t* of the connection plate 30*a* with the stud bolts 40 extending through the fastener-receiving openings 103, 105 of all of the joint inserts and with the second metal sheet layer 104 facing outwardly. The nuts 42 are threaded onto the stud bolts 40 and tightened against the previously-installed third and fourth joint inserts 100 on that side of the connection plate 30*a* to join the exhaust manifold 10 and the support bracket 30 together. The end surfaces or faces 42*s*, 42*t* of the nuts 42 engage the outer joint surfaces or faces of the third and fourth joint inserts positioned on that side of the connection plate 30*a*. In assembling the joints, the joint inserts 100 can be placed on exhaust manifold surfaces or faces 30*e*, 30*f* and bracket surfaces or faces 30*s* with either the first metal sheet layer 102 or the second metal sheet layer facing the joint surfaces or faces 10*e*, 10*f* or 30*s*, 30*t*.

A second embodiment of the invention involves a joint insert 200 that is provided as a one-piece unit for collective joint J1 and as a one-piece unit for collective joint J2, resulting in the need to assemble only two joint inserts 200, one for each collective joint J1, J2 instead of the four joint inserts 100 according to the first embodiment.

Figure 5:
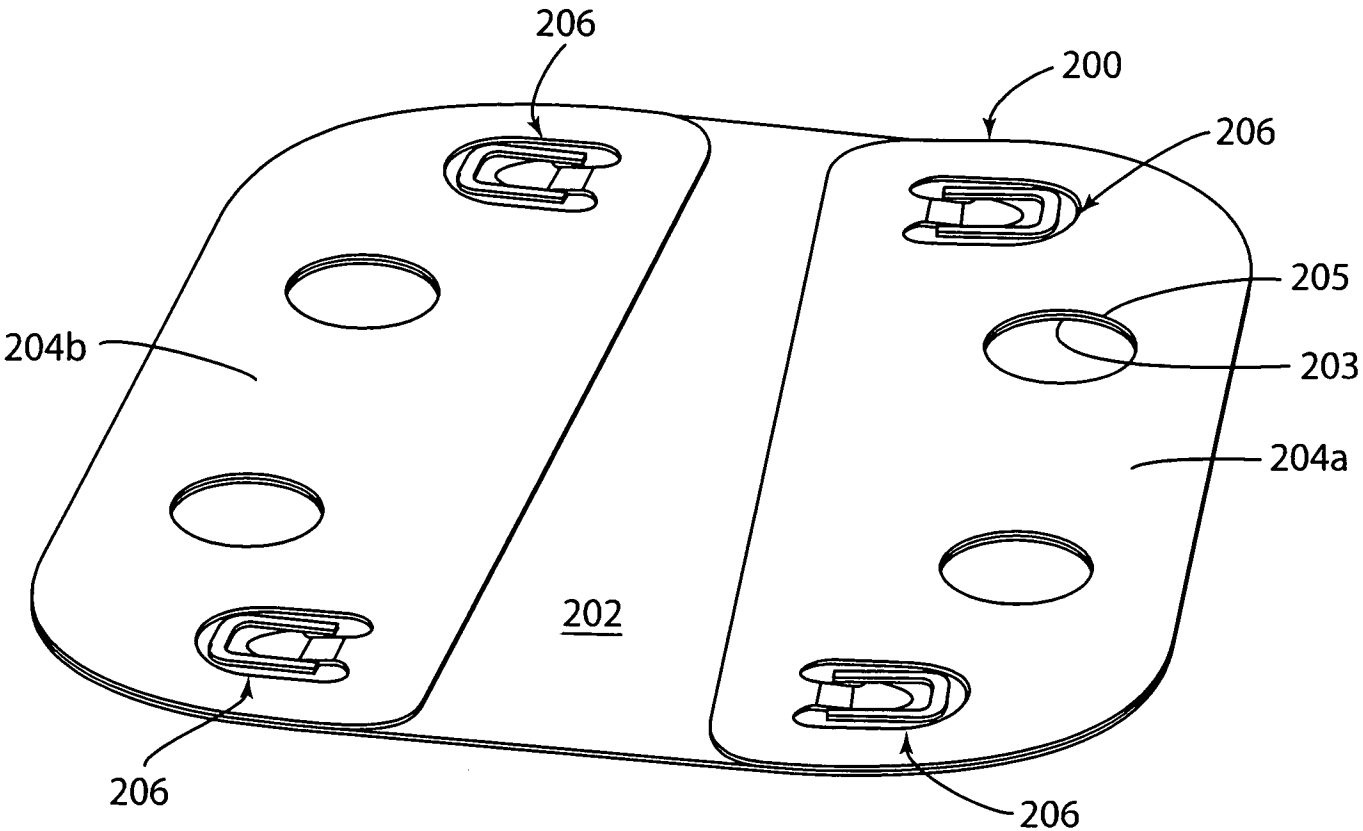
FIG. 5 a perspective view of a one-piece multi-layer joint insert pursuant to another embodiment of the present invention wherein separate second metal sheet layers are laterally disposed apart on a shared or common first metal sheet layer.

The second embodiment of joint insert 200 is illustrated in FIG. 5. The second embodiment differs from the first embodiment in having a second sheet metal layer that is provided as separate second metal sheet layers 204*a*, 204*b* which are disposed and spaced apart on a common or shared first metal sheet layer 202. Each separate metal sheet layer 204*a*, 204*b* is joined to the shared or common first sheet metal layer 202 by a respective at least one connecting arrangement 206 of the type described above with respect to the first embodiment of the invention. For purposes of illustration, two such connecting arrangements 206 are shown associated with each separate sheet metal layer 204*a*, 204*b*.

The shared first metal sheet layer 202 includes fastener-receiving openings 203 mutually aligned with the fastener-receiving openings 205 of the separate metal sheet layers 204*a*, 204*b* thereon, FIG. 5, to receive the stud bolts 40.

As in the first embodiment, the aforementioned anti-friction material preferably is disposed between the first metal sheet layer 202 and the separate second sheet metal layers 204*a*, 204*b* to reduce interlayer friction.

The second embodiment thus involves the combination of exhaust manifold 10 of the internal combustion engine and a component, such as support bracket 30, held on the exhaust manifold by stud bolts 40/nuts 42 with a joint insert 200 disposed at the collective joints J1 (formed between exhaust manifold joint surfaces or faces 10*e*, 10*f* and the bracket joint surfaces or faces 30*e*, 30*f*) and another joint insert 200 disposed at collective joints J2 (formed between the bracket joint surfaces or faces 30*s*, 30*t* and nut end surfaces 42*s*, 42*t*).

In the second embodiment of the invention described above, one joint insert 200 is placed on the joint surfaces or faces 10*e*, 10*f* of the exhaust manifold 10 with the stud bolts 40 extending through the fastener-receiving openings 203. For example, the joint insert 100 can be positioned such that the separate second metal sheet layers 204*a*, 204*b* contact the respective first and second joint surfaces or faces 10*e* of the exhaust manifold. Then, the connection plate 30*a* of the bracket 30 is placed on the respective previously-installed joint insert 200 with the joint surfaces or faces 30*e*, 30*f* of the connection plate 30*a* facing the joint surfaces or faces 10*e*, 10*f* of the exhaust manifold. Another one joint insert 200 then is placed on the opposite outer joint surfaces or faces 30*s*, 30*t* of the connection plate with the separate second metal sheet layers 204*a*, 204*b* facing outwardly. The nuts 42*a* are threaded onto the stud bolts 40 and tightened to join the exhaust manifold 10 and the support bracket 30 together. The end surfaces 42*s*, 42*t* of the nuts 42 engage the joint insert 200 on that side of the connection plate 10*a*. In assembling the joints, the joint inserts 200 can be placed on exhaust manifold surfaces or faces 10*e*, 10*f* and bracket surfaces or faces 30*s*, 30*t* with either the first metal sheet layer 202 or the separate second metal sheet layers 204*a*, 204*b* facing the joint surfaces or faces 30*e* or 30*s*.

A third embodiment of the invention involves a joint insert 300 that is provided as a one-piece unit for all collective joints J1 and J2 and results in the need to assemble only one joint insert unit 300 with the exhaust manifold 10 and the support bracket 30 using the stud bolts 40/nuts 42.

Figure 6:
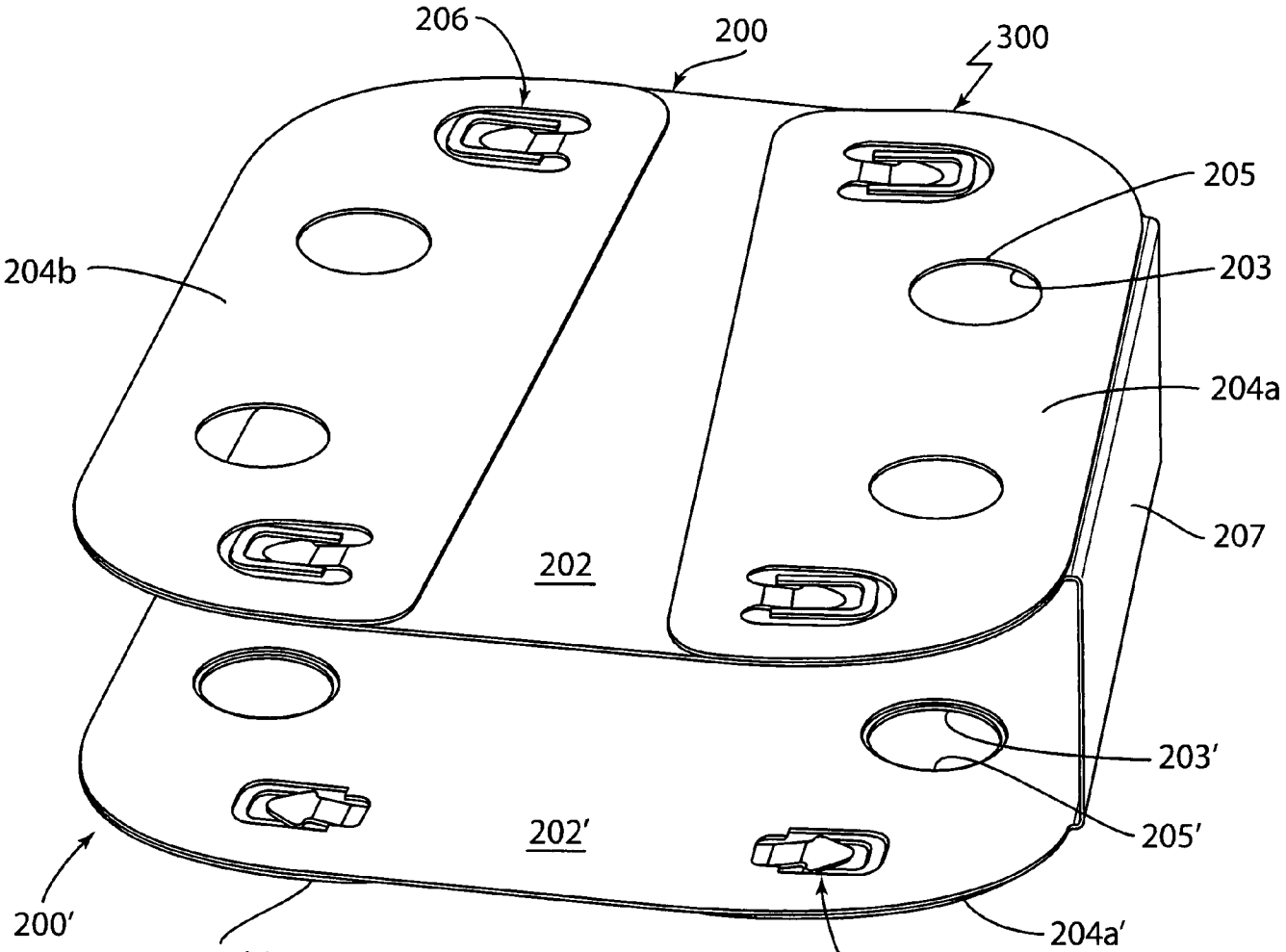
FIG. 6 a perspective view of a unitary multi-layer joint insert pursuant to another embodiment of the present invention for use at first and second joints wherein first and second joint insert sections of the type shown in FIG. 5 are joined as a one-piece, U-shaped joint insert unit by modifying the first metal sheet layer to include a sheet metal connector section joining the first and second joint insert sections in a region that will reside outside of the joints.
Figure 7:
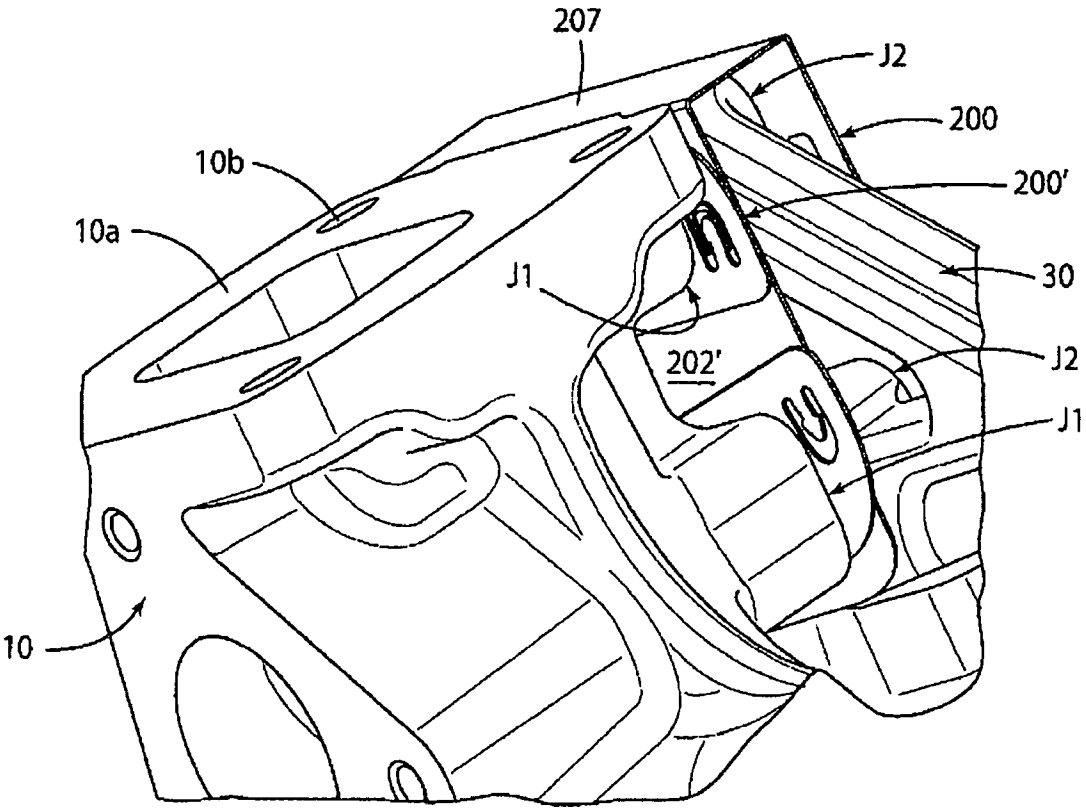
FIG. 7 a perspective view of the mechanical joints J1, J2 between the exhaust manifold and the support bracket face showing the joint insert at that joint.
Figure 8:
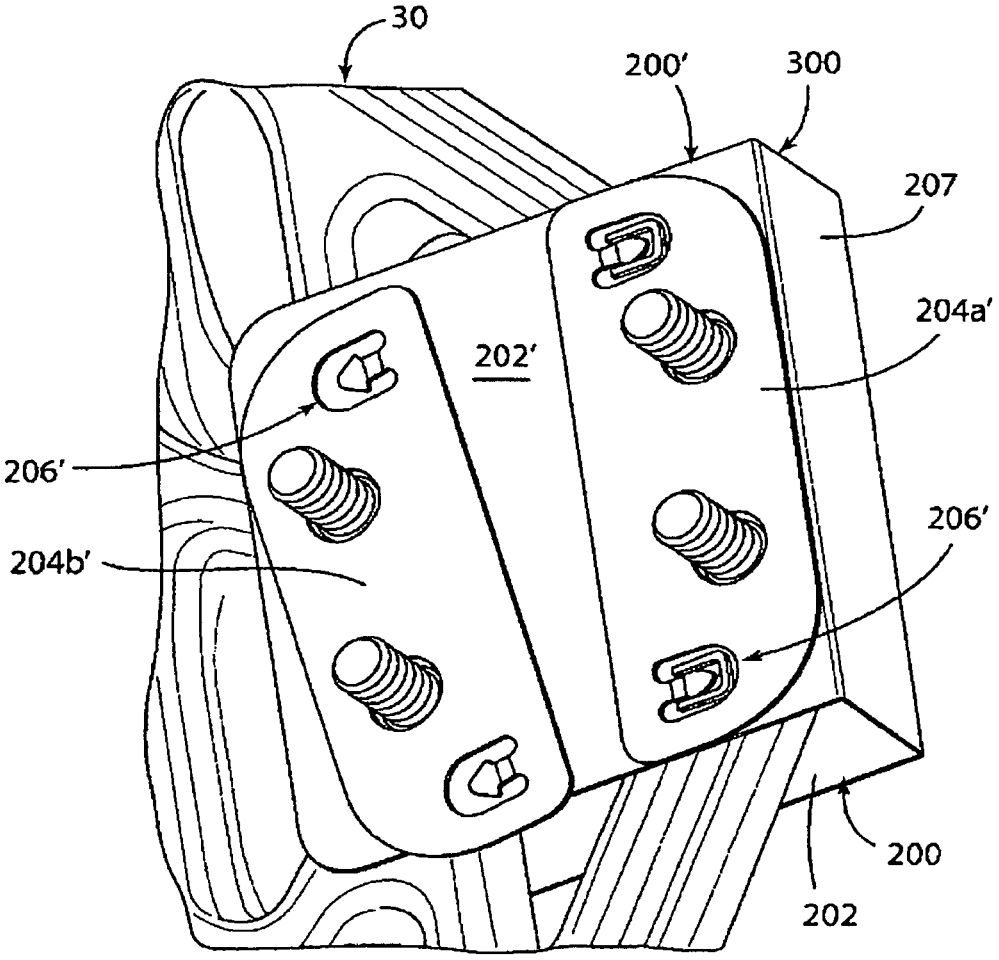
FIG. 8 a perspective view of the mechanical joint-forming an outer side of the connection plate of the support bracket face showing the joint insert for positioning at that joint.

The third embodiment of joint insert 300 is illustrated in FIGS. 6-8, where like reference numerals primed or not represent like features of FIGS. 1-3 and 5. The joint insert 300 comprises first and second joint insert sections 200, 200' of the type described above for the second embodiment having the first metal sheet layer 202, 202' and separate second metal sheet layers 204*a*, 204*b* ; 204*a* ', 204*b* ' jointed thereto by connecting arrangement 206, 206', but differs from the second embodiment in that the first metal sheet layer 202 is modified to include a metal sheet layer connector section 207 that extends between and connects the first and second joint insert sections 200 as one unit. The metal sheet layer connector section 207 preferably is formed as an integral part of the first sheet metal layers 202, 202' such as by suitable bending of the first metal sheet layers 202, 202'. For purposes of illustration and not limitation, the first (inner) joint insert section 200 and the second (outer) joint insert section 200' are joined together as one unit; for example as a U-shaped unit wherein the first and second joint insert sections 200, 200' form the legs of the U-shape joint insert 300, FIG. 6.

The third embodiment of the invention thus provides the combination of an exhaust manifold 10 of an internal combustion engine and a component, such as support bracket 30, and the joint insert 300 held on the exhaust manifold by stud bolts 40/nuts 42. The joint insert insert 300 is assembled with the first joint insert section 200 disposed at collective joints J1 between the exhaust manifold 10 and the support bracket connection plate 30*a* and with second join insert section 200' at collective joints J2 between bracket joint surfaces or faces and the nut end surfaces or faces. The metal sheet connector section 207 connects the first and second joint insert sections 200, 200' and resides outside the joints J1, J2, FIGS. 7-8.

In the third embodiment of the invention, the connection plate 30*a* of the support bracket is positioned in the gap of the joint insert 300; i.e. between the first and second joint insert sections 200, 200'. The joint insert 300 and the connection plate 30*a* of the support bracket 30 then are placed over the stud bolts 40 with the inner joint insert 200' received on the surfaces or faces 10*e*, 10*f* of the exhaust manifold and with the outer joint insert section 200 received on bracket joint surfaces of faces 30*s*, 30*t*. The metal sheet connector section 207 may include a hole and be bolted to bracket 30 for retention purposes during assembly. The stud bolts 40 extend through the fastener-receiving openings 203, 205; 203', 205' of the joint insert sections 200, 200'. The nuts 42 are threaded onto the stud bolts 40 and tightened to join the exhaust manifold 10 and the support bracket 30 together. The surfaces or faces 42*s*, 42*t* of the nuts 42 engage the respective separate metal sheet layers 204*a*, 204*b* of the outer joint insert section 200 on that side of the connection plate 30*a*, FIG. 1.

Although the present invention has been described with respect to illustrative embodiments, those skilled in the art will appreciate that changes and modifications can be made therein within the scope of the appended claims.

We claim:

1. A method of joining a component and an exhaust manifold of an internal combustion engine at a first joint and a second joint wherein the first joint is between the component and the exhaust manifold and the second joint is between the component and a surface of at least one fastener, comprising pre-connecting a first joint insert and a second joint insert by a metal sheet connector to provide a one-piece joint insert unit, placing the first joint insert of the joint insert unit at the first joint between the component and the exhaust manifold, placing the second joint insert of the joint insert unit at the second joint, said first joint insert and said second joint insert each having a first metal sheet layer and a separate second metal sheet layer that are relatively slidable and are joined together by at least one connecting arrangement that permits relative sliding movement between the first metal sheet layer and the second metal sheet layer in response to thermally-generated stress at at least one of the first joint and the second joint during operation of the internal combustion engine, and fastening the component and the exhaust manifold together at the first joint and the second joint using said at least one fastener received in a respective fastener-receiving opening in the first metal sheet layer and in the second metal sheet layer of the first joint insert and of the second joint insert.

2. A method of joining a component and an exhaust manifold of an internal combustion engine at a first joint and a second joint wherein the first joint is between the component and the exhaust manifold and the second joint is between the component and at least one of a head and nut of one or more fasteners, comprising the steps of:

pre-connecting a first joint insert and a second joint insert by a metal sheet connector to provide a one-piece joint insert unit, placing the first joint insert of the joint insert unit at the first joint, placing the second joint insert of the joint insert unit at the second joint, said first joint insert and said second joint insert each having a first metal sheet layer and a second metal sheet layer joined together by at least one connecting arrangement that permits relative sliding movement between the first metal sheet layer and the second metal sheet layer in response to thermally-generated stress at at least one of the first joint and second joint during operation of the internal combustion engine, and fastening the component and the exhaust manifold together at the first joint and the second joint using the one or more fasteners received in respective fastener-receiving openings in the first metal sheet layer and in the second metal sheet layer of the first joint insert and of the second joint insert.

* * * * *